US006803731B2

(12) United States Patent
Grabner et al.

(10) Patent No.: US 6,803,731 B2
(45) **Date of Patent: *Oct. 12, 2004**

(54) OPERATING CIRCUIT FOR A DISCHARGE LAMP WITH EARLY EOL DETECTION

(75) Inventors: Martin Grabner, Munich (DE); Markus Heckmann, Munich (DE)

(73) Assignee: Patent Treuhand Gesellschaft fur elektrische Gluhlampen mbH, Munich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 10/378,908

(22) Filed: Mar. 5, 2003

(65) Prior Publication Data

US 2003/0168994 A1 Sep. 11, 2003

(30) Foreign Application Priority Data

Mar. 5, 2002 (DE) ..... 102 09 619

(51) Int. Cl.[7] ..... H05B 37/00
(52) U.S. Cl. ..... 315/225; 315/228
(58) Field of Search ..... 315/291, 223, 315/224, 228, 229, 231, 225; H05B 37/00

(56) References Cited

U.S. PATENT DOCUMENTS 6,177,768 B1 * 1/2001 Kamata et al. ..... 315/241 R
6,198,231 B1 * 3/2001 Schemmel et al. ..... 315/225
6,646,390 B2 * 11/2003 Grabner et al. ..... 315/225

* cited by examiner

*Primary Examiner*—Don Wong
*Assistant Examiner*—Trinh Vo Dinh

(57) ABSTRACT

The invention relates to a novel operating circuit for a low-pressure discharge lamp 1 with early EOL detection via a measurement of the DC voltage between the electrodes 2, 3. In this case, the DC voltage can be modified by an offset voltage 10 such that only one polarity has to be taken into account during measurement.

14 Claims, 2 Drawing Sheets

OPERATING CIRCUIT FOR A DISCHARGE LAMP WITH EARLY EOL DETECTION

TECHNICAL FIELD

The invention relates to an operating circuit for a low-pressure discharge lamp.

BACKGROUND ART

Low-pressure discharge lamps have lamp electrodes, as a rule two electrodes per lamp, that have a limited service life. The end of the service life of the lamp is generally given by the end of the service life of an electrode.

It is known that low-pressure discharge lamps should be replaced if at all possible when the failure of an electrode is imminent. The reason for this is chiefly that shortly before the end of the service life of an electrode there is an unusually high electrode drop that leads to high temperatures of the electrode and of the neighboring region of the discharge lamp. This can result in safety problems, above all in the case of small low-pressure discharge lamps and heat-sensitive installation situations.

Use is made for this purpose of detection circuits for detecting the end of the service life of the electrodes (end-of-life detection: referred to below as EOL detection, for short). One known option for early EOL detection consists in measuring the voltage across a so-called coupling capacitor that connects an electrode to the positive or negative terminal of the supply and decouples the lamp in DC terms and couples it in AC terms to the supply. This coupling capacitor is charged in normal operation on average over time to half the supply voltage. Deviations from this value can be sensed by a comparator and used for detecting an impending end of service life.

This optional solution has proved to be disadvantageous with regard to accuracy and technical outlay.

DISCLOSURE OF THE INVENTION

Starting therefrom, the invention is based on the technical problem of specifying an operating circuit for a low-pressure discharge lamp with an EOL detection circuit that is simple and permits reliable and safe operation of the lamp.

Provided according to the invention for this purpose is an operating circuit in which the EOL detection circuit can measure the DC voltage between the electrodes in order to carry out the early detection with the aid of the measured DC voltage, and the DC voltage between the electrodes can be modified by an offset voltage such that only one polarity occurs when measuring the modified DC voltage between the electrodes by means of the EOL detection circuit.

The particular feature of the operating circuit according to the invention resides in the fact that the EOL detection circuit now measures the DC voltage between the electrodes of the low-pressure discharge lamp. Given completely intact electrodes, ideally no DC voltage occurs during operation. It should be recalled here that the low-pressure discharge lamp is operated solely with the aid of alternating current and is decoupled in DC terms from the operating circuit.

However, it has emerged that a DC voltage results with increasing electrode degeneration by virtue of the fact that a somewhat more pronounced electrode drop zone is formed in front of the electrode which is likely to have the shorter service life. The low-pressure discharge lamp therefore has a rectifying effect overall. This asymmetry is increased by the advancing aging of the electrode with the shorter service life up to its failure. A voltage threshold for which the early detection of expected failure of an electrode takes place can be established empirically.

The advantage resides in the measurement of comparatively low voltages that can be processed with the aid of semiconductor components without the need for excessively high voltage divider ratios. Specifically, voltage divider circuits with high division ratios are always associated with accuracy problems that can be resolved only by a costly selection of components. In addition, the inventive mode of procedure of directly measuring the DC voltage between the electrodes is particularly simple and scarcely dependent on further details of the operating circuit.

The invention also provides that this DC voltage measurement is performed such that an offset voltage produces a shift in the DC voltage, effected by the processes in the interior of the lamp, between the electrodes such that finally only voltage values of one polarity occur in the range of the DC voltages which is permissible before the early EOL detection. It is thereby possible to simplify considerably the design of the measuring device used for the DC voltage measurement.

Furthermore, it is also possible to make use in the invention of a voltage divider circuit for dividing the DC voltage to be measured between the electrodes, a tapping point being provided for the EOL detection circuit. By contrast with the prior art described, however, the invention requires detection between the electrodes of only comparatively low voltages that necessitate a very much weaker voltage division than the half supply voltage, used conventionally, at the so-called coupling capacitor. Thus, the sensitivity to faults in the components used is also lower.

According to the invention, these advantages may be associated with the fact that the EOL detection circuit has an electrode interrogation function. The safety advantage already achieved for the operating circuit by early EOL detection can be further enhanced by the electrode interrogation function. Specifically, the electrode interrogation determines whether the terminal or terminals of a holder, connected to the operating circuit, for the low-pressure discharge lamp is/are connected to the associated electrode. If no electrode is present, the low-pressure discharge lamp is not correctly inserted or is defective. If no electrode is present, presumably no discharge lamp has been inserted at all, and this gives rise to the need to prevent the application of high voltage to the holder in order to exclude danger to persons.

The electrode interrogation function is performed by virtue of the fact that the EOL detection circuit can sense a reference potential via the respective electrode. If the connection to the reference potential is lacking, this is sensed by the EOL detection circuit, the result being information about the presence of the electrode.

Advantages result even if only one electrode can be interrogated in the way described. This is because even at this stage the safety aspect of preventing voltage from being applied in the event of a missing discharge lamp occurs. In particular, it is possible in this case to interrogate an electrode "nearer to ground", because contacting the electrode "remote from ground" would be less dangerous (interrogation of the "cold end").

However, an interrogation of all the existing electrodes is advantageously provided, that is to say of two electrodes, as a rule. This gives the advantage, for example, of also being able, in any situation, to detect a defect in a discharge lamp just inserted. In the case of this embodiment, the EOL detection circuit must thus be connected to in each case a first terminal of all the electrodes, whose respective other terminal is connected to the respective reference potential.

The use of the potential of the operating circuit, serving as ground, for the or at least one of the reference potentials is, due to its simplicity, a particularly advantageous variant of the invention.

Furthermore, one embodiment provides that electrode interrogation uses the same measuring input and the same electrode taps as the DC voltage measurement for the purpose of early EOL detection.

The measurement of the DC voltage—possibly voltage-divided—between the electrodes and the electrode interrogation function are preferably carried out via a microcontroller. Furthermore, this microcontroller can also supply an output voltage to be used to generate the offset voltage. The output of the microcontroller that is used for the offset voltage is preferably connected via a resistor to the already mentioned tapping point of the voltage divider circuit. Reference is made to the exemplary embodiment.

Furthermore, the operating circuit according to the invention can be configured such that it responds in the case of early EOL detection only when the DC voltage between the electrodes that triggers the detection has already occurred for a specific minimum time. This is because experience demonstrates that it is possible at the start of operation and also during continuous operation for short-term phenomena to arise in the discharge lamp which could trigger an early EOL detection, that is to say cause correspondingly high DC voltages between the electrodes. Such faulty detections can be prevented by defining a minimum sensing time. In the case of the microcontroller already mentioned, consideration is given, for example, to loop interrogations or averaging operations over a specific number of measured values. This time delay can be tolerated without danger because of the thermal inertia, present in any case, of the discharge lamp itself.

In addition, the operating voltage can also be designed for a plurality of discharge lamps, for example for two discharge lamps. It is then preferred to provide a series connection of electrodes of one of the discharge lamps and an electrode of the other discharge lamp. The remaining electrode can then be connected to ground. Reference may be made to the exemplary embodiment.

BRIEF DESCRIPTION OF THE DRAWINGS

Two exemplary embodiments are described below for the purpose of a more detailed illustration of the invention, it also being possible for the individual features disclosed to be essential to the invention in other combinations. In the drawing.

BEST MODE FOR CARRYING OUT THE INVENTION

Figure 1:
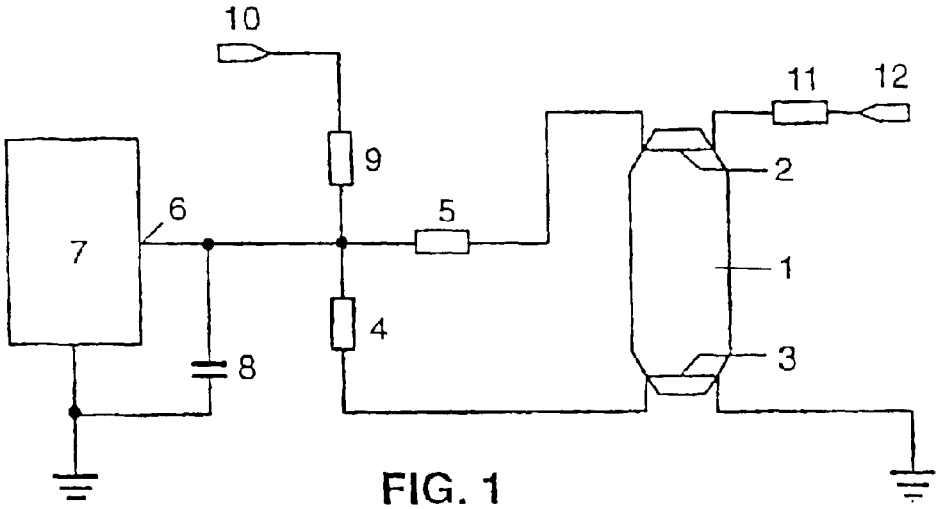
FIG. 1 shows a schematic of the circuit design of an operating circuit according to the invention for a low-pressure discharge lamp.

Illustrated in FIG. 1 by 1 is a low-pressure discharge lamp that contains two electrodes 2 and 3. As is usual in the case of low-pressure discharge lamps, these are preheatable filament electrodes. The electrodes 2 and 3 are supplied with a high-frequency supply power by a half-bridge oscillator circuit (not illustrated here in more detail and otherwise conventional) such that a discharge can be struck and maintained in the discharge lamp 1. Provided for the purpose of preheating the electrodes 2 and 3 are appropriate preheating circuits that could likewise be conventional, and are therefore not illustrated.

The terminals of the electrodes 2 and 3 that are respectively the left-hand ones in FIG. 1 are connected to a voltage divider circuit comprising two resistors 4 and 5 which is used to divide a DC voltage present between electrodes 2 and 3. The reference potential (ground) is present at the other terminal of the electrode 3. An input 6 of a microcontroller 7 is connected to the tapping point between the resistors 4 and 5. This voltage input 6 is connected to ground via a capacitor 8 such that the microcontroller 7 evaluates only DC voltage signals.

The tapping point between the resistors 4 and 5, and thus the voltage input 6 of the microcontroller 7 are connected via a further resistor 9 to an auxiliary voltage source 10 that is actually likewise made available in this example by the microcontroller 7. Furthermore, the terminal of the top electrode 2 in FIG. 1 that is not connected to the voltage divider circuit 4, 5 is connected to a further auxiliary voltage source 12 via a resistor 11. All the voltages are accordingly defined with reference to ground. The auxiliary voltage source 12 corresponds in this exemplary embodiment to a supply voltage that is present in any case in the analogue electronics (for example of MOSFET drivers) in the range of 12–18 V. Its potential in this example is therefore somewhat higher than that of the auxiliary voltage source 10 of the microcontroller 7.

If a DC voltage occurs between the electrodes 2 and 3 during the continuous operation of the discharge lamp 1, it is divided downward in accordance with the resistors 4, 5 and 9 at the voltage input 6 of the microcontroller 7. Thus, the resistors 4, 5 and 9 can undertake a level adaptation to the technical preconditions of the microcontroller 7 with regard to the voltage input 6. Since the high-frequency supply voltage components between the electrodes 2 and 3 are short-circuited to ground via the capacitor 8 with a relatively low impedance, while the resistors 4 and 5 have relatively high values, the voltage input 6 is virtually free of such high-frequency components.

The voltage level can be effectively displaced between the electrodes 2 and 3 with the aid of the auxiliary voltage source 10 via the resistor 9. The auxiliary voltage source 10 provides an offset voltage for this purpose, such that the same polarity always results between the electrodes 2 and 3 at the voltage input 6 of the microcontroller 7 for all permissible DC voltages, taking account of the numerical relationships between the resistors 4, 5 and 9. In this case there is unavoidably a certain modification of the potential relationships in the discharged lamp 1 itself. However, if the resistors 4 and 5 are sufficiently large this effect is rather a theoretical one. No practical effects result therefrom. Should disturbances arise here, the auxiliary voltage sources 10 and 12 could also be operated intermittently, that is to say be activated only at specific time intervals, in order to carry out an interrogation. The influence on the discharge physics would then be limited to these comparatively short time periods.

The second auxiliary voltage 12 offers an option for the electrode interrogation with reference to the electrode 2. If this electrode 2 is present and conducting, the potential at the voltage input 6 is influenced by the auxiliary voltage source 12. If the electrode 2 is not present or no longer conducting, the potential at the voltage input 6 is influenced only by the voltage divider circuit 9, 4. The resistor 11 serves for feeding an auxiliary current to the measuring branch.

The electrode interrogation functions in a similar way with reference to the electrode 3, the ground terminal serving as reference potential. If the electrode 3 fails, the potential at the voltage input 6 is determined by the voltage divider circuit 5, 9 and 11 as well as by the auxiliary voltage sources 10 and 12. If no discharge lamp 1 has been inserted at all, or both electrodes 2, 3 have failed, the auxiliary voltage source 10 alone determines the level of the voltage input 6.

By using two auxiliary voltage sources 10 and 12 (theoretically also with only one auxiliary voltage source), it is possible with the aid of a single voltage measuring input 6 of the microcontroller 7 to carry out both a very simple early EOL detection and a dual electrode interrogation.

By means of simple digital operations such as averaging operations covering a specific number of measuring operations (for example of 0.5 s or slightly more) or loop interrogations, the microcontroller 7 can ensure that the early EOL detection is not taken into consideration when the effect occurs only briefly. Only four additional resistors are required apart from the microcontroller (at least if the offset voltage and the dual electrode interrogation are present simultaneously). Because of the relatively moderate division ratio of the voltage divider circuit, no difficulties of practical relevance arise as to the accuracy of the resistors. Given skilful selection of the auxiliary voltages and of the resistance values, the conceivable voltage values at the voltage measuring input 6 are in a direct 1:1 relationship with the various operating states to be determined. Typical quantitative values are 0–5 V as the measuring range for the voltage measuring input 6, 1 V–5 V as the voltage value of the auxiliary voltage source 10, and 5 V–500 V as the voltage value for the auxiliary voltage source 12. The values of the resistors can be, for example, 3.9 kΩ to 1 MΩ for 4, 47 kΩ to 2.2 MΩ for 5, 3.9 kΩ to 330 kΩ for 9, 47 kΩ to 10 MΩ for 11, and 100 pF to 1 $\mu$F for the capacitor 8.

As an example, let the resistor 4 be 56 kΩ, the resistor 5 be 330 kΩ and the resistor 9 be 47 kΩ, the resistor 11 be 470 kΩ and the capacitor 8 be 100 nF. The values of the auxiliary voltage sources 10 and 12 are 5 V and 15 V, respectively. The following exemplary assignments then result between various operating states and voltage values at the voltage measuring input 6: with the lamp 1 not yet started but intact, the voltage at point 6 is 3.10 V.

If the lamp 1 has not yet been started and the upper filament is defective, the measured value is 2.72 V and if the lower filament is defective, it is above 5 V and can be limited by the measuring input 6. If the lamp 1 has been started and is in order, the measured value is 2.52 V. If the lamp has been started and a DC voltage of, for example, 20 V has developed between the electrodes in the positive direction, the measured value is 3.96 V, and 1.09 V for the same DC voltage in the negative direction. It can be seen from this that given suitable dimensioning the voltage value at the measuring input 6 can be brought into a unique relationship with the various operating states.

Figure 2:
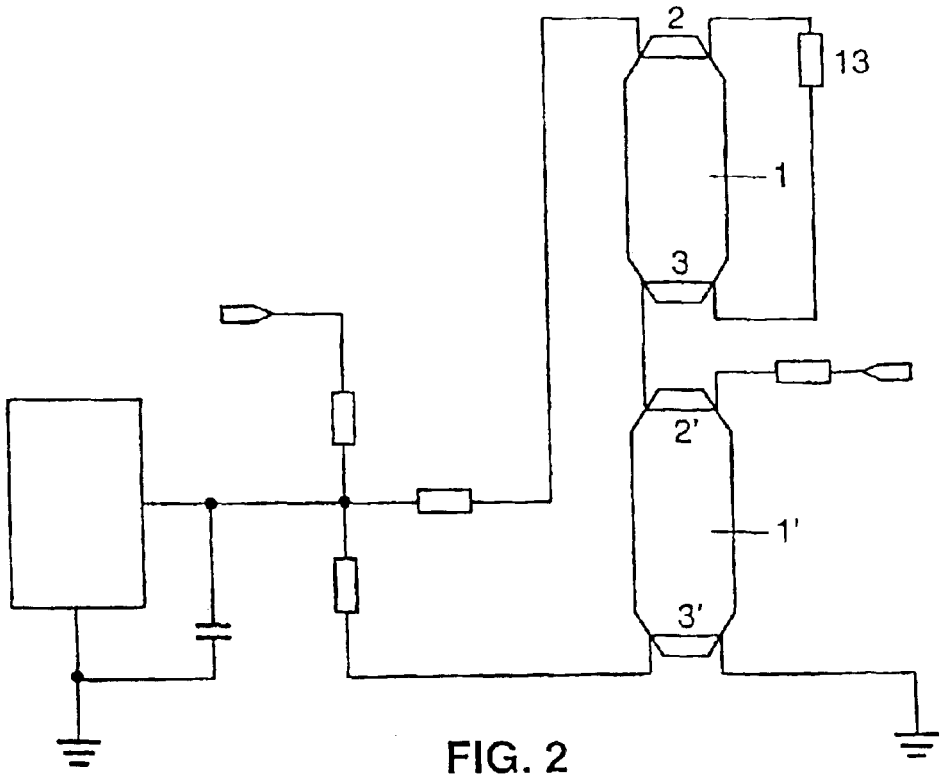
FIG. 2 shows a corresponding design of an operating circuit for two low-pressure discharge lamps.

The above statements hold correspondingly for the second exemplary embodiment from FIG. 2, which is distinguished from FIG. 1 in that two discharge lamps 1 and 1' are provided. The electrodes are denoted correspondingly by 2, 3, 2', 3'. FIG. 2 shows that the electrodes 2, 3 and 2' are connected to the auxiliary voltage source 12 with the aid of a further resistor 13 (for preventing a short circuit between the electrodes 2 and 3), while the electrode 3' is connected, in turn, to ground. The remainder of the design is identical to FIG. 1 (apart from the dimensioning of the actual supply circuit). It can be seen that it is possible to sense both a DC voltage between the electrodes 2 and 3 and a DC voltage between the electrodes 2' and 3' because they are added together in the voltage divider circuit 4, 5. The theoretically conceivable case in which the DC voltages between the electrodes 2 and 3, on the one hand, and 2' and 3', on the other hand, develop oppositely at the same time in an exactly matching relationship such that they compensate one another completely is so improbable, above all with regard to the temporal course of the development of the DC voltages between electrodes, as well, that it is of no import for practical application.

Furthermore, the electrodes 2, 3 and 2' can be interrogated via the auxiliary voltage source 12. The failure or the absence of each electrode can thus be detected in the case of this embodiment.

However, it is not possible to distinguish a failure of the electrodes 2, 3 and 2' via the electrode interrogation.

Figure 3:
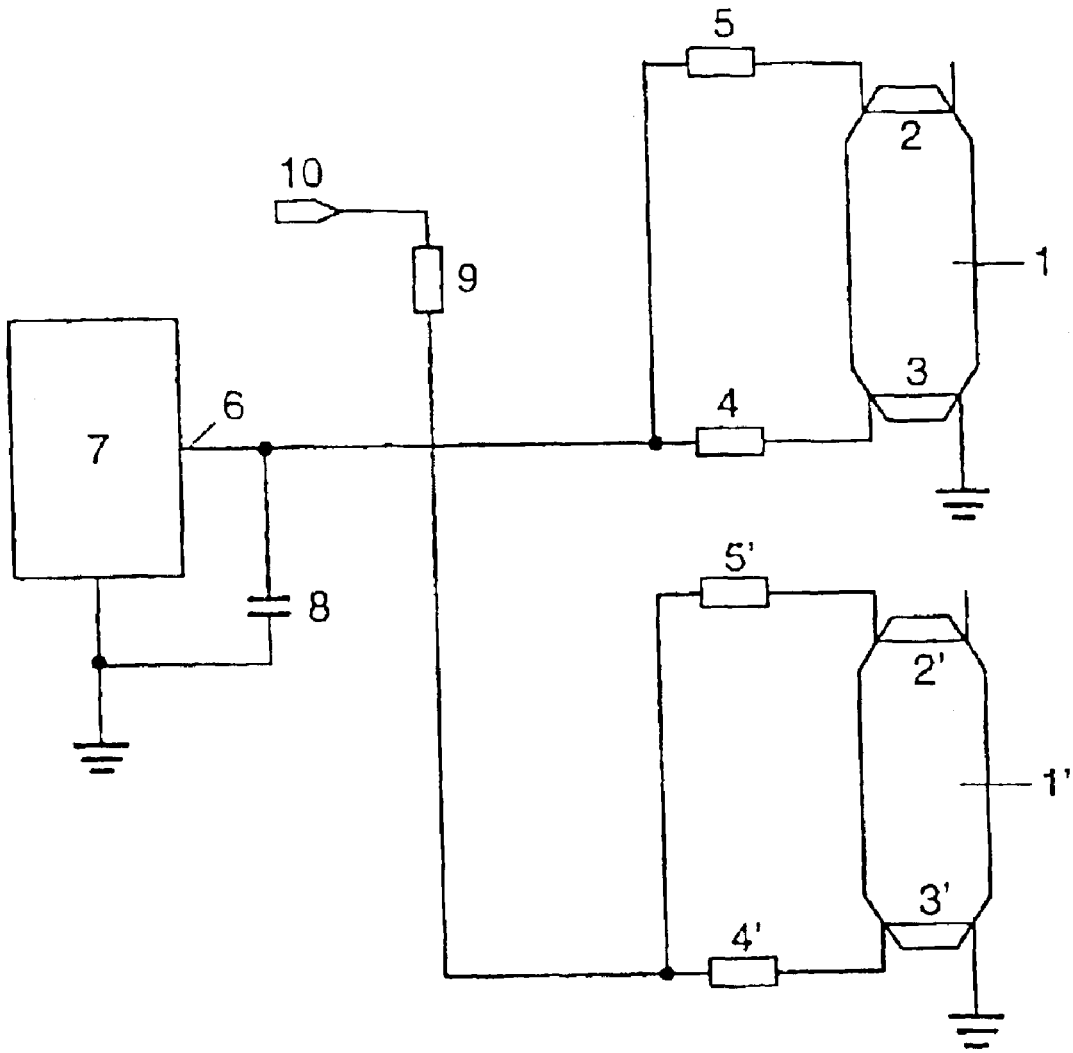
FIG. 3 shows a corresponding design in the operating circuit for two low-pressure discharge lamps according to an alternative embodiment.

FIG. 3 shows a third exemplary embodiment with an operating circuit that likewise consists of two discharge lamps 1 and 1'. In this exemplary embodiment, the described filament interrogation is respectively performed only for the lower electrode 3 and 3', respectively, because in the application this forms the "cold end" of the lamp 1 or 1', respectively. For this reason, it is possible here to monitor two lamps 1 and 1', operating in parallel, in a particularly simple way with the aid of a standard circuit. The early EOL detection is performed respectively via the already explained resistors 4 and 5 or 4' and 5', respectively. When the DC voltage between the electrodes 2 and 3 or between the electrodes 2' and 3' is too high, this is sensed exactly as in the case of the first exemplary embodiment from FIG. 1. The difference consists only in that DC voltages at the voltage measuring input 6 become noticeable between the electrodes of both lamps 1 and 1'. The theoretically conceivable situation of an exactly opposing development of DC voltages in the same lamps which compensate for one another at the voltage measuring input 6 is irrelevant in practice because it is extremely improbable. However, it can happen that voltages have already formed in each case at both lamps 1 and 1' with the consequence that triggering occurs upon overshooting of a threshold value when neither of the DC voltages corresponds exactly to this threshold value. On the other hand, the exact magnitude of the threshold value is not necessarily important in practice, and so it is possible in practice to operate effectively in the way sketched out in FIG. 3.

What is claimed is:

1. An operating circuit for a low-pressure discharge lamp (1, 1') with lamp electrodes (2, 3, 2', 3') and an BOL detection circuit (4-13) for early detection of an expected electrode failure, characterized in that the EOL detection circuit (4-13) is operable to measure the DC voltage between the electrodes (2, 3, 2', 3') in order to carry out the early detection with the aid of the measured DC voltage, the measured DC voltage between the electrodes (2, 3, 2', 3') is modified by an offset voltage (10) to produce a modified DC voltage having only one polarity, and the operating circuit further includes a voltage divider circuit (4,5) that is provided between the electrodes (2, 3, 2', 3') and that includes a tapping point for the EOL detection circuit (4-13).

2. The operating circuit as claimed in claim 1, in which the EOL detection circuit (4-13) is combined with an electrode interrogation function, the EOL detection circuit (4-13) being connected to in each case a first terminal of at least one electrode (2, 3, 2', 3') whose other second terminal is connected to a reference potential (12) such that an electrode interrogation is carried out by checking the electric connection via the electrode to the reference potential (12).

3. The operating circuit as claimed in claim 2, in which the EOL detection circuit (4-13) is connected to in each case a first terminal of both electrodes (2, 3, 2', 3') whose respective other, second terminal is connected to a respective reference potential (12) such that an electrode interrogation is carried out by checking the electric connection via the respective electrode (2, 3, 2', 3') to the respective reference potential (12).

4. The operating circuit as claimed in claim 3, in which one of the two reference potentials is ground.

5. The operating circuit as claimed in claim 2, in which one of the two reference potentials is ground.

6. The operating circuit as claimed in claim 2, in which the EOL detection circuit (4-13) carries out the electrode interrogation via the same measuring input (6) and the same electrode taps as the measurement of the DC voltage between the electrodes (2, 3, 2', 3').

7. The operating circuit as claimed in claim 2, in which the EOL detection circuit (4-13) has a microcontroller (7) for at least one of: (i) measuring the DC voltage between the electrodes (2, 3, 2', 3'); and (ii) the electrode interrogation function.

8. The operating circuit as claimed in claim 7, in which the microcontroller (7) is operable to supply an output voltage (10) that is used to generate the offset voltage.

9. The operating circuit as claimed in claim 8, in which the output (10) of the microcontroller for the offset voltage is connected via a resistor (9) at the tapping point of the voltage divider circuit (4, 5).

10. The operating circuit as claimed in claim 2, in which the EOL detection circuit (4-13) is designed to the effect that given a DC voltage between the electrodes (2, 3, 2', 3') that lies above a specific value a signal indicating the early detection is generated only when the DC voltage has already occurred for a specific minimum time.

11. The operating circuit as claimed in claim 2, which is designed for two discharge lamps (1, 1'), the electrodes (2, 3) of one of the discharge lamps (1) and an electrode (2') of the other discharge lamp (1') being connected in series via a resistor (13) and connected to an electrode tap, the other electrode (3') of the other discharge lamp being connected to ground.

12. The operating circuit as claimed in claim 1, in which the EOL detection circuit (4-13) is designed to the effect that given a DC voltage between the electrodes (2, 3, 2', 3') that lies above a specific value a signal indicating the early detection is generated only when the DC voltage has already occurred for a specific minimum time.

13. The operating circuit as claimed in claim 1 which is designed for two discharge lamps (1, 1'), the electrodes (2, 3) of one of the discharge lamps (1) and an electrode (2') of the other discharge lamp (1') being connected in series via a resistor (13) and connected to an electrode tap, the other electrode (3') of the other discharge lamp being connected to ground.

14. The operating circuit as claimed in claim 1, in which the EOL detection circuit (4-13) is combined with an electrode interrogation function, the BOL detection circuit (4-13) being connected to in each case a first terminal of at least one electrode (2, 3, 2', 3') whose other second terminal is connected to a reference potential (12) such that an electrode interrogation is carried out by checking the electric connection via the electrode to the reference potential (12).

* * * * *